US012484619B2

(12) United States Patent
Xu et al.

(10) Patent No.: US 12,484,619 B2
(45) Date of Patent: Dec. 2, 2025

(54) ATOMIZING CORE, ATOMIZER AND ELECTRONIC ATOMIZING DEVICE

(71) Applicant: SHENZHEN SMOORE TECHNOLOGY LIMITED, Shenzhen (CN)

(72) Inventors: Wenxiao Xu, Shenzhen (CN); Xinyu Wang, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 1282 days.

(21) Appl. No.: 17/218,636

(22) Filed: Mar. 31, 2021

(65) Prior Publication Data

US 2021/0307396 A1 Oct. 7, 2021

(30) Foreign Application Priority Data

Apr. 2, 2020 (CN) ..... 202010254321.X

(51) Int. Cl.
*A24F 40/46* (2020.01)
*A24F 40/10* (2020.01)
*A24F 40/48* (2020.01)

(52) U.S. Cl.
CPC ..... *A24F 40/46* (2020.01); *A24F 40/10* (2020.01); *A24F 40/48* (2020.01)

(58) Field of Classification Search
CPC ..... A24F 40/10; A24F 40/40; A24F 40/46; A24F 40/48
USPC ..... 392/386
See application file for complete search history.

(56) References Cited

U.S. PATENT DOCUMENTS

2020/0359704 A1* 11/2020 Deng ..... A24F 40/70
2021/0401046 A1* 12/2021 Yamada ..... A24F 40/42

FOREIGN PATENT DOCUMENTS

| | | | | | |
|---|---|---|---|---|---|
| CN | 104039184 | A | | 9/2014 | |
| CN | 106974324 | A | * | 7/2017 | ..... A24F 47/008 |
| CN | 110074463 | A | | 8/2019 | |
| CN | 209915042 | U | * | 1/2020 | |
| CN | 212545544 | U | | 2/2021 | |
| EP | 3417726 | A1 | * | 12/2018 | ..... A24F 40/40 |
| WO | 2017139963 | A1 | | 8/2017 | |
| WO | WO-2017190648 | A1 | * | 11/2017 | ..... A24F 47/00 |
| WO | 2019144308 | A1 | | 8/2019 | |

OTHER PUBLICATIONS

Extended European Search Report for European Patent Application No. 21166417.2 mailed Aug. 27, 2021.
First Office Action for Chinese Patent Application No. 202010254321.X mailed Oct. 22, 2024.

* cited by examiner

*Primary Examiner* — Ibrahime A Abraham
*Assistant Examiner* — Joseph W Iskra
(74) *Attorney, Agent, or Firm* — Ballard Spahr LLP

(57) ABSTRACT

An atomizing core is configured to be electrically connected to a battery of an electronic atomizing device, the electronic atomizing device defines an air suction channel, the electronic atomizing device includes a mouthpiece at an end of the air suction channel. The atomizing core includes a base and a heater. The base is configured to store liquid and has an atomizing surface located in the air suction channel, wherein the atomizing surface is arranged to face away from the battery and towards the mouthpiece. The heater is arranged on the atomizing surface and configured to atomize the liquid.

19 Claims, 10 Drawing Sheets

ATOMIZING CORE, ATOMIZER AND ELECTRONIC ATOMIZING DEVICE

CROSS REFERENCE TO RELATED APPLICATIONS

This application claims priority to Chinese Patent Application No. 202010254321.X, filed on Apr. 2, 2020, entitled "ATOMIZING CORE, ATOMIZER AND ELECTRONIC ATOMIZING DEVICE", and the entire content of which is incorporated herein by reference.

TECHNICAL FIELD

The present disclosure relates to a field of electronic atomization technology, and in particular, to an atomizing core, an atomizer, and an electronic atomizing device.

BACKGROUND

There are dozens of carcinogens in the smoke of tobacco burning, for example, tar may cause huge damage to human health, and the smoke diffused in the air forms second-hand smoke, which also cause harm to the health of the surrounding people after the inhalation thereof. Therefore, smoking is prohibited in most public places. The electronic atomizing device has an appearance and taste similar to that of ordinary cigarette, but does not contain harmful components such as tar and suspended particles in the ordinary cigarette. Therefore, the electronic atomizing device is generally used to replace an actual cigarette.

An electronic atomizing device mainly includes an atomizer and a power supply assembly, the power supply assembly supplies electrical energy to the atomizer, and the atomizer converts the electrical energy into thermal energy. After the e-liquid absorbs the thermal energy and atomizes to form smoke for the user to inhale. However, the traditional electronic atomizing device usually has a problem of the poor smoke density due to insufficient amount of the smoke, and hence fails to offer a favorable user experience.

SUMMARY

According to various embodiments, an atomizing core, an atomizer, and an electronic atomizing device are provided.

An atomizing core is configured to be electrically connected to a battery of an electronic atomizing device. The electronic atomizing device defines an air suction channel, the electronic atomizing device includes a mouthpiece at an end of the air suction channel. The atomizing core includes a base and a heater. The base is configured to store liquid and has an atomizing surface located in the air suction channel, wherein the atomizing surface is arranged to face away from the battery and towards the mouthpiece. The heater is arranged on the atomizing surface and configured to atomize the liquid.

An atomizer includes a housing, a connecting assembly, and the aforementioned atomizing core. The housing defines a liquid reservoir, the connecting assembly is at least partially received in the housing. The atomizing core is mounted on the connecting assembly. The air suction channel is defined in the connecting assembly and is isolated from the liquid reservoir. A part of the base absorbs the liquid from the liquid reservoir.

An electronic atomizing device includes a power supply assembly and the aforementioned atomizer. The power supply assembly is connected to the connecting assembly and is at least partially received in the housing.

According to the above atomizing core, atomizer, and electronic atomizing device, the atomizing surface is arranged away from the battery and towards the mouthpiece, and the heater is attached to the atomizing surface. When the heater generates heat, the liquid on the atomizing surface absorbs the heat and is atomized to generate smoke. The smoke can enter the air suction channel directly without bypassing the atomizing core, and reach the mouthpiece for the user to inhale. Therefore, the loss of the smoke bypassing the atomizing core may be reduced, so as to ensure the sufficient amount of the smoke per unit time can be effectively inhaled by the user, thus improving the effective amount of the smoke per unit time generated by the electronic atomizing device. Further, since the distance between the atomizing surface and the mouthpiece is relatively small, making the path of the smoke to the mouthpiece the shortest, which further reduces the loss of the smoke in the air suction channel, thus further improving the effective amount of the smoke per unit time generated by the electronic atomizing device.

BRIEF DESCRIPTION OF THE DRAWINGS

To illustrate the technical solution according to the embodiments of the present disclosure or related art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Figure 1:
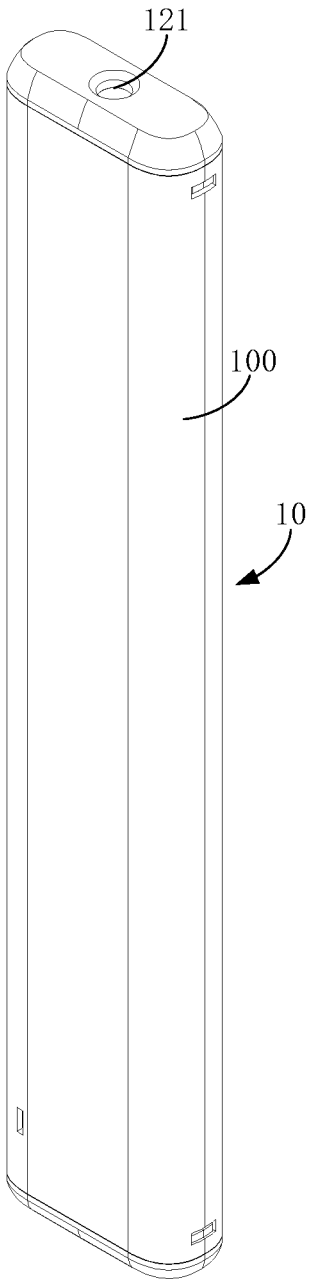
FIG. 1 is a perspective view of an electronic atomizing device according to an embodiment.

In order to make the above objects, features and advantages of the present disclosure more obvious and understandable, the specific embodiments of the present disclosure will be illustrated in detail below in conjunctions with the accompanying drawings. In the following description, many specific details are set forth in order to assist readers in fully understanding of the present disclosure. However, the present disclosure can be implemented in many other ways than described herein, and those skilled in the art can make similar improvements without departing from the connotation of the present disclosure. Therefore, the present disclosure is not limited by the specific embodiments disclosed below.

In the description of the present disclosure, it should be understood that orientation or positional relationships indicated by terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc. are based on orientation or positional relationship shown in the drawings, which are merely to facilitate the description of the present disclosure and simplify the description, not to indicate or imply that the device or elements must have a particular orientation, be constructed and operated in a particular orientation, and therefore cannot be construed as a limitation on the present disclosure.

In addition, the terms "first" and "second" are used for description only, and cannot be understood as indicating or implying relative importance or implicitly indicating the number of technical features described. Thus, the features defined with "first" and "second" may include at least one of the features explicitly or implicitly. In the description of the present disclosure, the meaning of "plurality" is at least two, such as two, three, etc., unless explicitly defined otherwise.

In the present disclosure, unless explicitly specified and limited otherwise, the terms "mounting", "connecting", "connected", "fixed" and the like should be understood in a broad sense. For example, it may be a fixed connection or a detachable connection, or an integration, may be a mechanical connection or electrical connection, may be a direct connection, or may be an indirect connection through an intermediate medium, may be the connection between two elements or the interaction relationships between two elements, unless explicitly defined otherwise. The specific meanings of the above terms in the present disclosure can be understood by one of those ordinary skills in the art according to specific circumstances.

In the present disclosure, unless explicitly specified and limited otherwise, the first feature being "on" or "below" the second feature may be that the first and second features are in a direct contact, or the first and second features are in an indirect contact through an intermediate medium. Moreover, the first feature being "over", "above" and "on" the second feature may be that the first feature is directly above or obliquely above the second feature, or simply means that the first feature is higher than the second feature in horizontal direction. The first feature being "beneath", "under", and "below" the second feature may be that the first feature is directly below or obliquely below the second feature, or simply means that the first feature is lower than the second feature in horizontal direction.

It should be noted that when an element is referred to as being "fixed" or "disposed on" another element, it may be directly on another element or there may also be an intermediate element therebetween. When an element is considered to be "connected" to another element, it may be directly connected to another element or there may be an intermediate element therebetween. As used herein, the terms "vertical", "horizontal", "upper", "lower", "left", "right", and similar expressions are for illustration only and are not meant to be the only embodiments.

Figure 2:
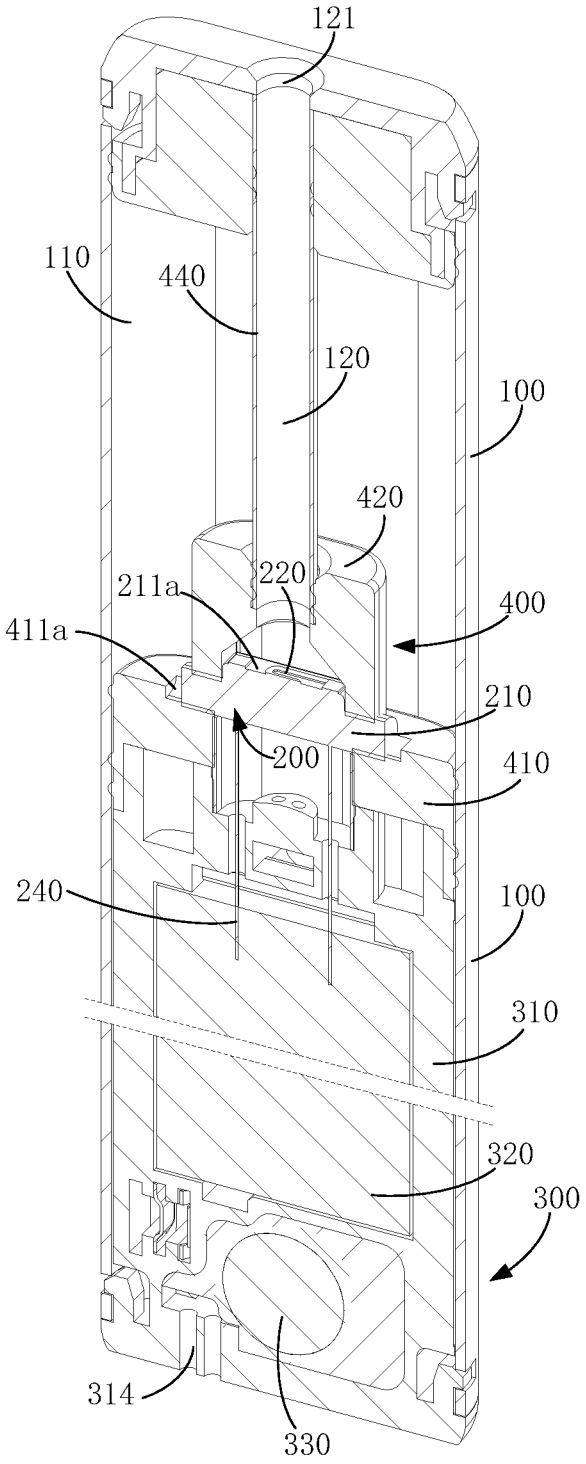
FIG. 2 is a cross-sectional view of the electronic atomizing device of FIG. 1.

Referring to FIG. 1 and FIG. 2, an electronic atomizing device 10 according to an embodiment is configured to atomize liquid, such as e-liquid. The electronic atomizing device 10 includes a housing 100, an atomizing core 200, a power supply assembly 300, and a connecting assembly 400. The connecting assembly 400 and the power supply assembly 300 are at least partially received in the housing 100, and the atomizing core 200 is mounted on the connecting assembly 400. The power supply assembly 300 supplies electric power to the atomizing core 200, and the atomizing core 200 converts the electric power to thermal energy for atomizing the liquid to smoke inhaled by the user.

Figure 3:
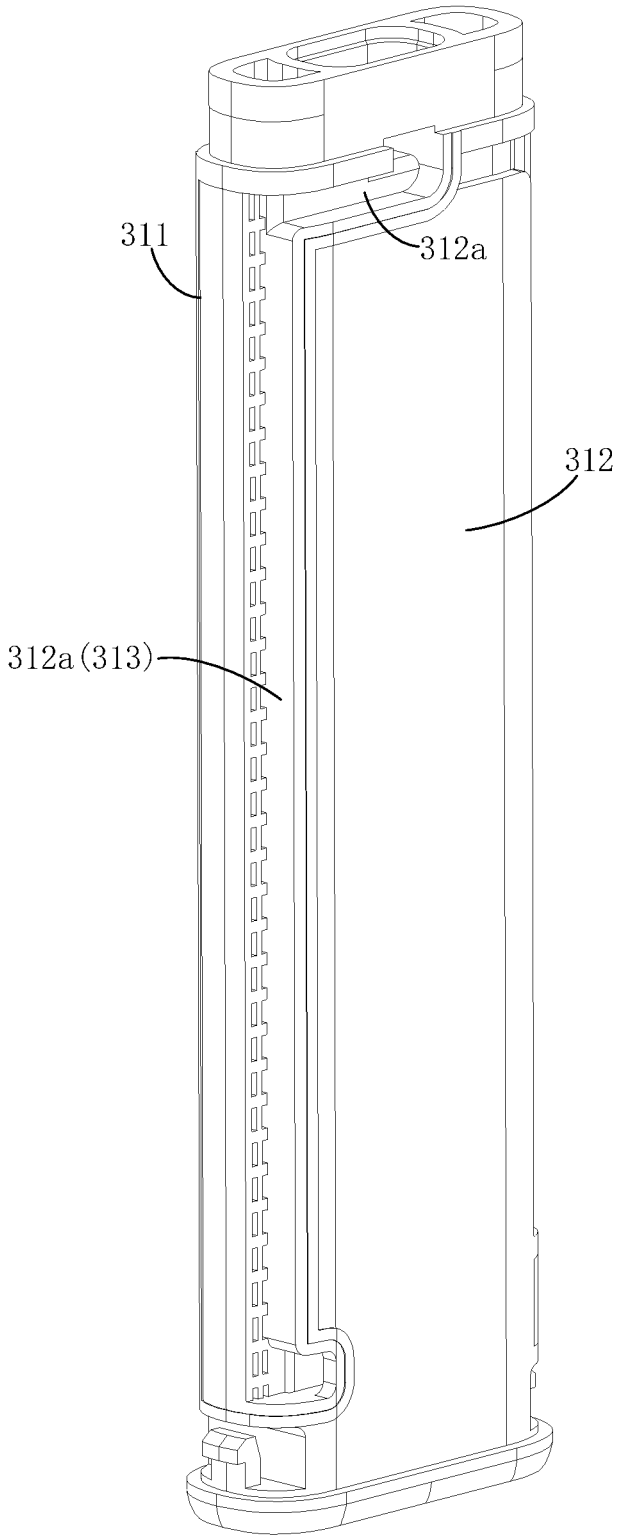
FIG. 3 is a perspective view of a power supply assembly of the electronic atomizing device of FIG. 1.
Figure 4:
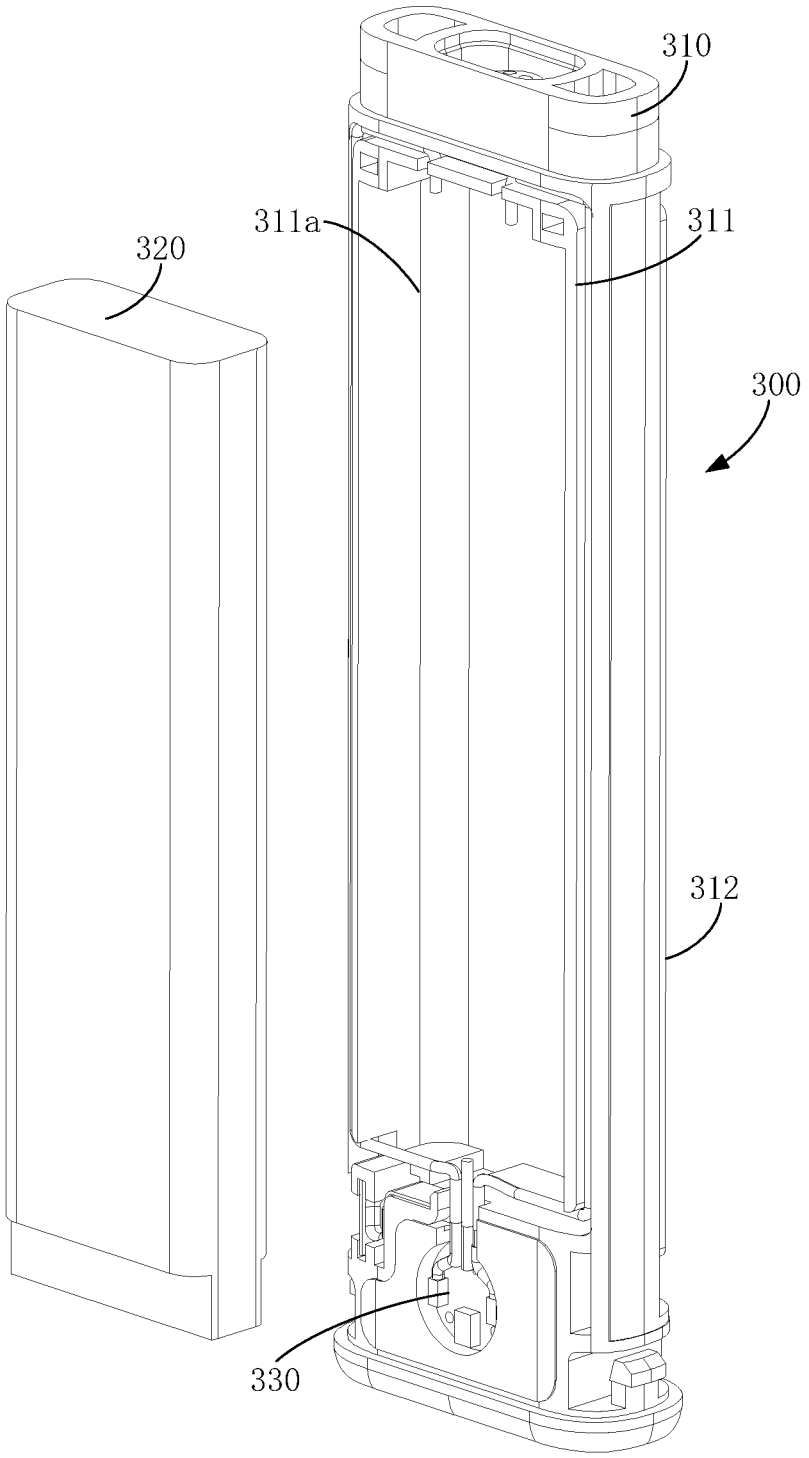
FIG. 4 is an exploded perspective view of the power supply assembly of the electronic atomizing device of FIG. 1.
Figure 5:
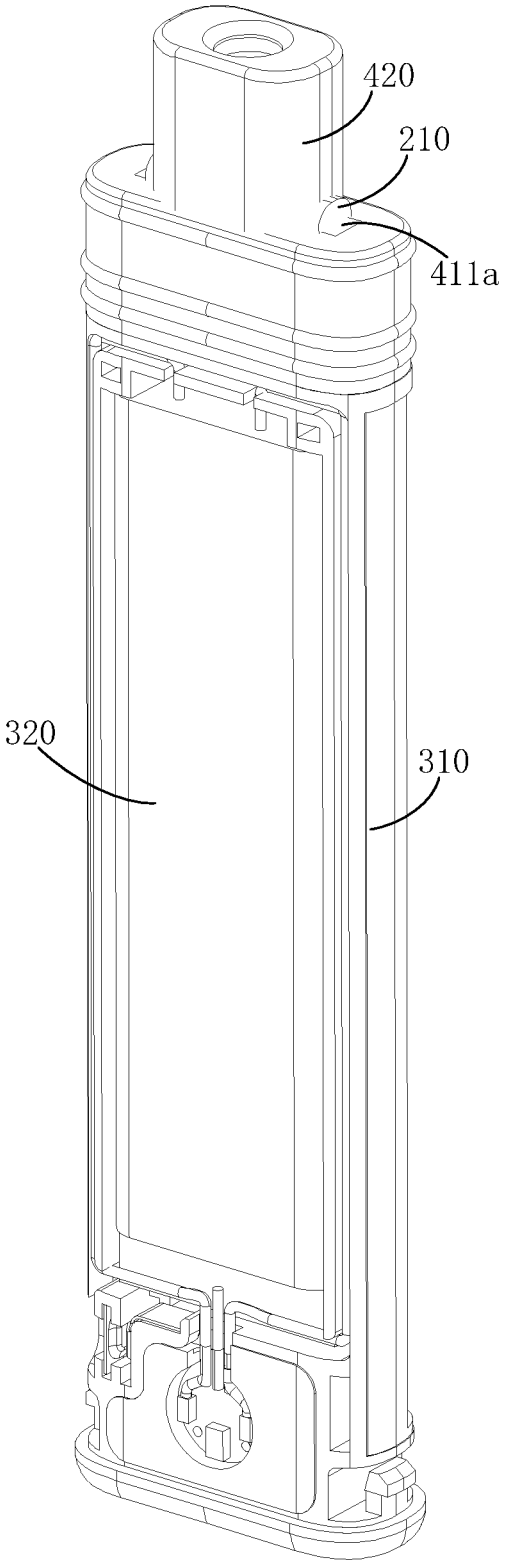
FIG. 5 is a perspective view of the electronic atomizing device of FIG. 1.

Referring to FIG. 3 and FIG. 4, in one embodiment, the power supply assembly 300 includes a mounting frame 310, a battery 320, and an actuation sensor 330. The mounting frame 310 is substantially a rectangular plate and includes two opposite side surfaces, i.e., a first surface 311 and a second surface 312. The first surface 311 is recessed to form a cavity 311*a*, and the battery 320 is received in the cavity 311*a*. A recess 312*a* is formed on the second surface 312. Specifically, the recess 312*a* may be formed by recessing an edge portion of the second surface 312. After the mounting frame 310 is mounted in the housing 100, the housing 100 will cover the recess 312*a* to form an air guiding channel 313 isolated from the cavity 311*a* to allow the airflow to pass. In other words, the cavity 311*a* is located on one side of the mounting frame 310, and the air guiding channel 313 is located on the other side of the mounting frame 310, such that the cavity 311*a* and the air guiding channel 313 are located on both sides of the mounting frame 310.

The mounting frame 310 further includes an end surface outside the housing 100. The end surface defines an air inlet 314 fluidly communicating external air with the air guiding channel 313. The air inlet 314 may not be in fluid communication with the cavity 311*a*, hence the external air entering from the air inlet 314 will be input into the air guiding channel 313, which means the external air entering from the air inlet 314 cannot go into the cavity 311*a*. The actuation sensor 330 may be arranged on the mounting frame 310 adjacent to the air inlet 314. The actuation sensor 330 may be provided with a sensing channel in fluid communication with the air inlet 314. When there is a negative pressure in the air inlet 314, the actuation sensor 330 may senses the negative pressure automatically via the sensing channel. When sensing the negative pressure by the sensing channel, the actuation sensor 330 will send a feedback signal to control the battery 320 to supply electric power to the atomizing core 200.

Figure 6:
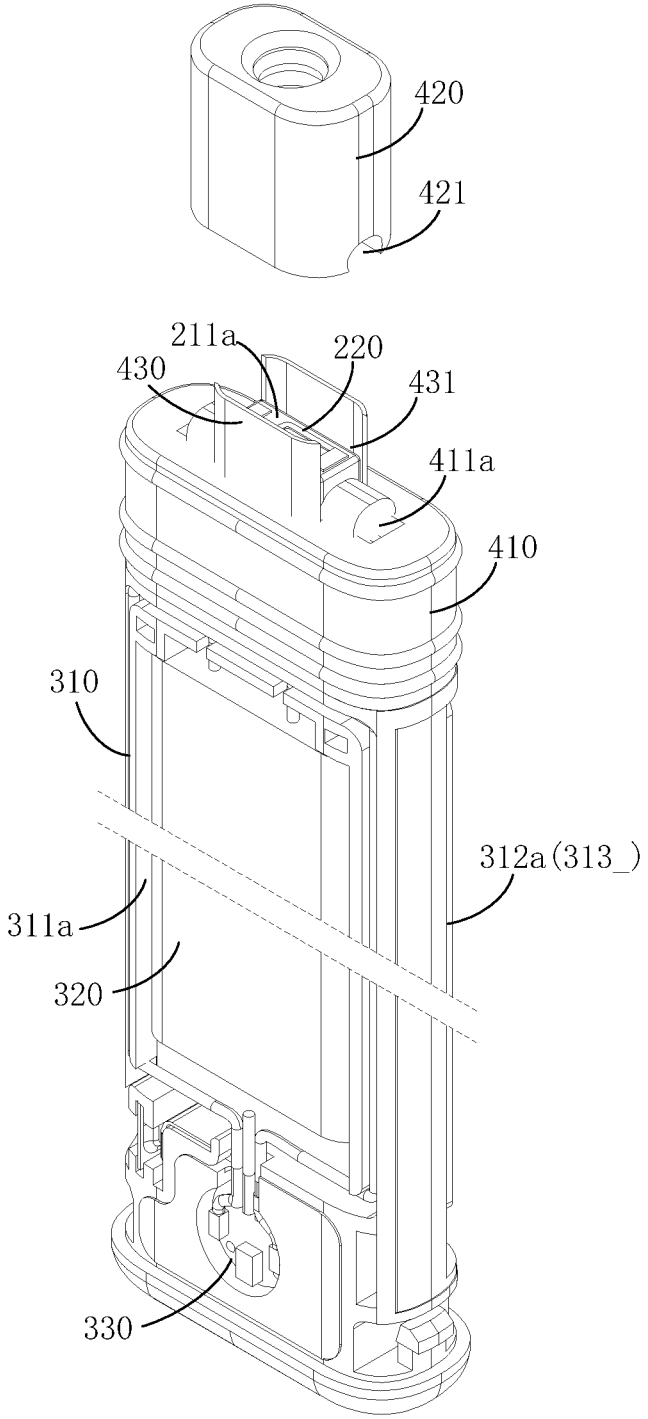
FIG. 6 is a partial exploded view of the electronic atomizing device of FIG. 5 according to an embodiment.
Figure 7:
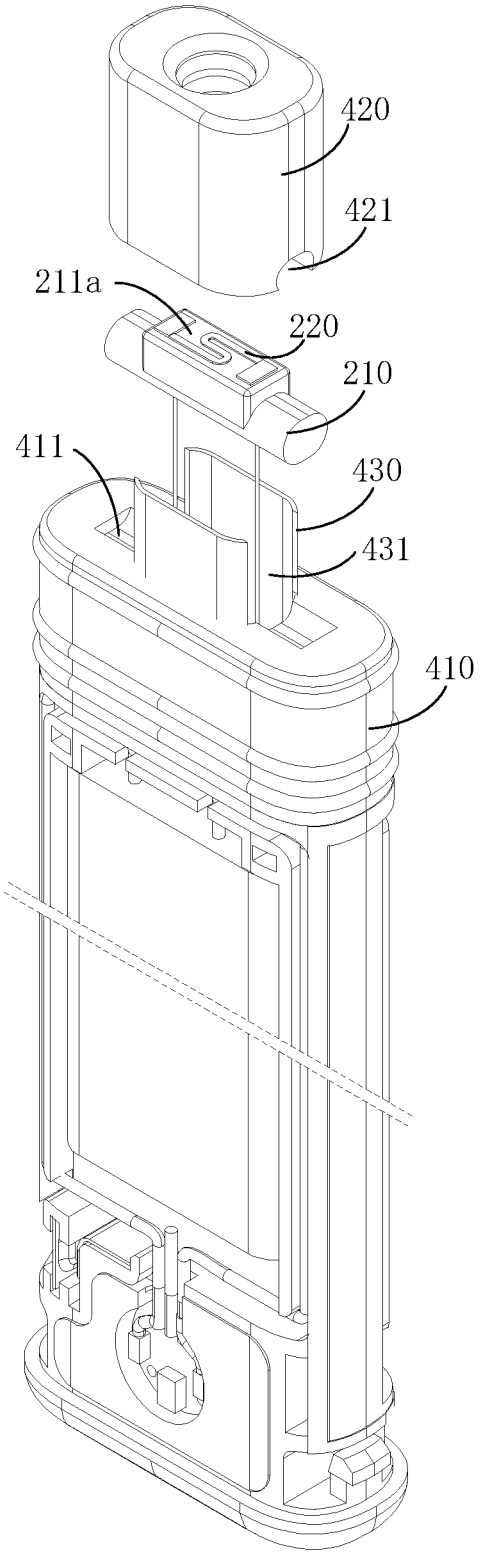
FIG. 7 is a partial exploded view of the electronic atomizing device of FIG. 5 according to another embodiment.

Referring to FIG. 2, FIG. 6 and FIG. 7, in one embodiment, the connecting assembly 400 includes a first sealing element 410, a second sealing element 420, a support 430, and an air conduit 440, which are all located in the housing 100. The housing 100 defines a liquid reservoir 110 therein configured to reserve liquid. The first sealing element 410 may be made of material such as silicone and is sleeved on the mounting frame 310, such that the first sealing element 410 is clamped between the mounting frame 310 and the housing 100, thereby enabling the first sealing element 410 to achieve a favorable sealing effect to the liquid reservoir 110 and prevents the liquid in the liquid reservoir 110 from leaking into the cavity 311*a* of the mounting frame 310. Therefore, the leakage of liquid can be prevented from corroding the battery 320, thus increasing the service life of the battery 320 and reducing unnecessary waste of liquid. An upper surface of the first sealing element 410 defines a part of boundary of the liquid reservoir 110, hence the upper surface of the first sealing element 410 is in direct contact with the liquid in the liquid reservoir 110.

Figure 8:
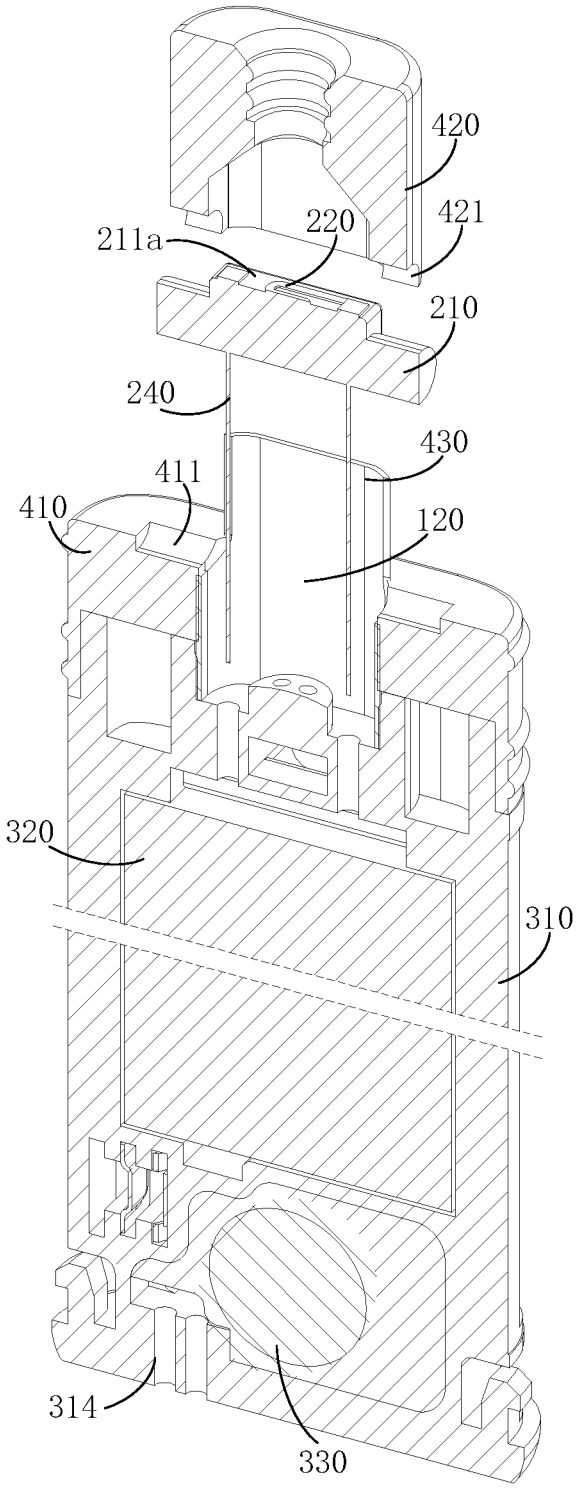
FIG. 8 is a cross-sectional view of the electronic atomizing device of FIG. 7.

Referring to FIG. 6, FIG. 7 and FIG. 8, the support 430 is of substantially a hallow cylindrical structure, and the support 430 extends through the first sealing element 410 and is connected to the power supply assembly 300. For example, both of the mounting frame 310 and the first sealing element 410 define an inserting hole, a middle portion of the support 430 extends through the inserting hole of the first sealing element 410, a bottom portion of the support 430 extends through the inserting hole of the mounting frame 310, such that the support 430 is inserted in the mounting frame 310 to realize fixed connection. An upper portion of the support 430 protrudes a certain height from an upper surface of the first sealing elements 410. The upper portion of the support 430 defines a latching slot 431, the atomizing core 200 is fitted in the latching slot 431, such that the support 430 clamps the atomizing core 200. Meanwhile, the latching slot 431 provides an avoidance space for mounting the assembly of the atomizing core 200, and hence the space in the support 430 may be fully utilized by the atomizing core 200, thus preventing the atomization core 200 from occupying the mounting space of the support 430 other than the length direction, improving the compactness of the electronic atomizing advice 10, reducing the volume of the electronic atomizing advice 10, achieving a miniaturized design of the electronic atomizing advice 10.

The second sealing element 420 is of substantially a cylindrical structure and may be made of silicone. The second sealing element 420 is located in the liquid reservoir 110 and is in direct contact with the liquid. The second sealing element 420 is sleeved on the upper portion of the support 430, such that the support 430 provides a positioning and supporting effect for the assembly of the second sealing element 420, thus ensuring the assembly accuracy and assembly stability of the second sealing element 420. A lower end of the second sealing element 420 is fixed on the first sealing element 410. Meanwhile, the second sealing element 420 defines a mounting notch 421 corresponding to the atomizing core 200. The mounting notch 421 also provides an avoidance space for the assembly of the atomizing core 200. In addition, the atomizing core 200 can also provide a supporting force for the assembly of the second sealing element 420, thus further ensuring the assembly stability of the second sealing element 420. Meanwhile, the second sealing element 420 is tightly fit with the atomizing core 200 to ensure the sealing effect of the liquid reservoir 110, thus preventing the liquid in the liquid reservoir 110 from leaking into the support 430.

The lower end of the air conduit 440 is inserted in the second sealing element 420. The upper end of the air conduit 440 is connected to housing 100. Inner cavities of the support 430, the second sealing element 420, and the air conduit 440 cooperatively form the air suction channel 120. In other words, the support 430, the second sealing element 420, and the air conduit 440 cooperatively enclose the air suction channel 120. Due to the sealing effect of both the first sealing element 410 and the second sealing element 420, the air suction channel 120 is isolated from the liquid reservoir 110, thus preventing the liquid in the liquid reservoir 110 from leaking to the air suction channel 120. During the smoking process, the user directly draws from the upper end opening of the air conduit 440 to obtain the smoke in the air suction channel 120, hence the upper end of the air conduit 440 forms a mouthpiece 121 of the air suction channel 120. Meanwhile, the air suction channel 120 is in fluid communication with the air guiding channel 313, and the air suction channel 120 is isolated from the cavity 311*a* of the mounting frame 310. Therefore, when the user draws at the mouthpiece 121, the outside air goes through the air inlet 314, the air guide channel 313, and the suction channel 120 successively and is inhaled by the user.

Figure 9:
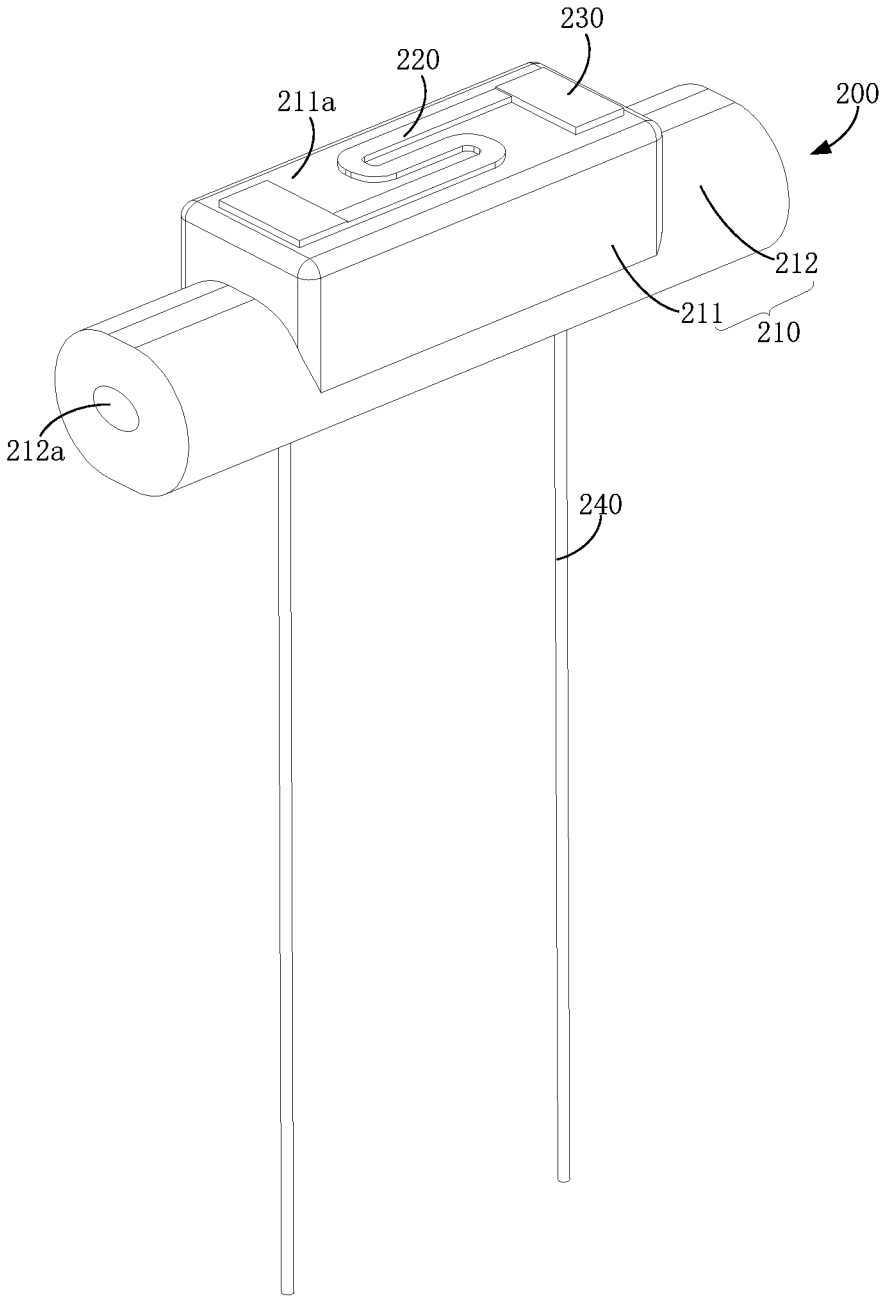
FIG. 9 is a perspective view of an atomizing core of the electronic atomizing device of FIG. 1.

Referring to FIG. 2 and FIG. 9, in one embodiment, the atomizing core 200 includes a base 210, a heater 220, and an electrode 230. The base 210 is configured to absorb the liquid from the liquid reservoir 110, and the heater 220 is configured to heat the liquid in the base 210 to generate smoke. The base 210 may be made of porous ceramic, such that the base 210 has some micropores to form a certain porosity, which generate a capillary force to absorb the liquid, thus the liquid can infiltrate to an inside of the base 210. The porosity can be defined as a ratio of volume of the micropores in the object to the object's overall volume in its natural state. The porosity of the base 210 ranges from 30% to 70%. Meanwhile, the base 210 made of porous ceramic material has good high temperature resistance characteristics, therefore, the liquid reserved in the base 210 does not react with the base 210 under the condition of high temperature, thus preventing the liquid from being wasted due to unnecessary chemical reaction. It can prevent the waste of liquid from affecting the amount of smoke produced by the atomizing core 200 per unit time, and it can also avoid the harmful substances produced by the liquid participating in the chemical reaction.

Referring to FIG. 7 and FIG. 9, the base 210 includes a protrusion 211 and a main body 212. The base 210 arranged in lateral direction and is shaped as cylinder or elliptic. The protrusion 211 is arranged in a middle portion of the base 210. The protrusion 211 may be of prismatic structure. The protrusion 211 protrudes a certain height from a surface of the main body 212 towards the mouthpiece 121. The protrusion 211 is located in the air suction channel 120. The mounting notch 421 of the second sealing member 420 matches with the main body 212, while the second sealing member 420 abuts against the side surface of the protrusion 211, such that the protrusion 211 provides a positioning effect for the mounting of the second sealing element 420, thereby improving the assembly stability and sealing effect thereof.

An upper surface of the first sealing element 410 is recessed to form a groove 411. During the assembly of the atomizing core 200, both ends of the main body 212 are located outside the air suction channel 120 and are fit with the groove 411. In other words, the first sealing element 410 can provide positioning and supporting effect for the whole atomizing core 200, so as to improve the assembly accuracy and assembly stability. The main body 212 may not be fully filled in the whole groove 411, such that a space is formed between an end surface of the main body 212 and an end surface of the groove 411. Referring to FIG. 2, the space forms a liquid guiding gap 411*a*. The liquid in the liquid reservoir 110 can enter the liquid guiding gap 411*a* quickly, and is in contact with a whole end surface of the main body 212, so as to increase a contact area of the main body 212 and the liquid, and hence the liquid in the liquid reservoir 110 can infiltrate to an interior of the atomizing core 200 quickly by the capillary force. Since sufficient liquid is reserved inside the atomizing core 200, dry burning due to insufficient liquid supply of the atomizing core 200 may be prevented, and it can effectively guarantee the amount of smoke produced per unit time and ensure that the smoke has sufficient concentration, thus avoiding the reduction of the amount of smoke generated per unit time due to the insufficient liquid in the atomizing core 200.

The main body 212 may define a liquid guiding hole 212*a* therein. The liquid guiding hole 212*a* extends along an axial direction thereof, such that a central axis of the liquid guiding hole 212*a* coincides with a central axis of the main body 212. The liquid guiding hole 212*a* penetrates both two end surfaces of the main body 212, such that the liquid guiding hole 212*a* is in fluid communication with the liquid reservoir 110 via the liquid guiding gap 411*a*. One part of the liquid of the liquid reservoir 110 may enter the atomizing core 200 through the micro pores, the other part of liquid thereof may enter the atomizing core 200 through the liquid guiding hole 212*a*. The pore diameter of the liquid guiding hole 212*a* may range from 1 mm to 3 mm, which means, the pore diameter of the liquid guiding hole 212*a* is significantly higher than the pore diameter of the micropores in the main body 212 by several orders of magnitude, which can ensure that the liquid can enter the interior of the atomizing core 200 through the liquid guiding hole 212*a* quickly, thus ensuring a sufficient liquid reserved inside the atomizing core 200, and ensuring the efficient producing of the amount of smoke per unit time for sufficient smoke concentration.

An upper surface of the protrusion 211 forms an atomizing surface 211*a*, which can be a plane. The atomizing surface 211*a* is arranged away from the battery 320 and towards the mouthpiece 121. In other words, the atomizing surface 211*a* is arranged away from the battery 320 rather than towards the battery 320. The heater 220 may be a heating film bending into an S-shape. The heater 220 may be made of metal material having good thermal conductivity. The electrode 230 is attached to the atomizing surface 211*a*. The electrode 230 includes a positive electrode and a negative electrode. The positive electrode is connected to an end of the heating film, and the negative electrode is connected to the other end of the heating film. The atomizing core 200 further includes two pins 240 extending through the base 210. The pins 240 are arranged vertically, and a lower end of the two pins 240 is electrically connected to the battery 320. Specifically, an upper end of the one pin 240 is connected to the positive electrode, and an upper end of the other pin 240 is connected to the negative electrode. Supplying the electric power for the heater 220 by the battery 320 may be achieved by the cooperation of the pin 240 and the electrode 230. When the heater 220 is powered by the battery 320, the liquid adsorbed to the atomizing surface 211*a* will absorb the heat generated by the heating element 220, so as to be atomized to smoke for the user to inhale.

It should be understood that in other embodiments, the pins 240 may not extend through the base 210, as long as the electrode 230 and the battery 320 can be electrically connected. In that case, the atomizing core 200 may not include the pin 240, and the battery 320 may be electrically connected to the electrode 230 directly by a pogo pin instead.

For a conventional atomizing core, the atomizing surface is always arranged facing a battery, and the heater is arranged on the atomizing surface, which makes the smoke generated by the atomizing surface has to bypass the atomizing core to reach the user to be inhaled. Further, the air suction channel is in fluid communication with the cavity for receiving the battery, and the air entering an air inlet may enter the air suction channel via the cavity.

Referring to FIG. 2, for the electronic atomizing device 10 described in the above embodiments, the atomizing surface 211*a* is arranged towards the mouthpiece 121, and the heater 220 is arranged on the atomizing surface 211*a*. When the heater 220 generates heat, the smoke generated by the liquid on the atomizing surface 211*a* can enter the air suction channel 120 and reach the mouthpiece 121 directly without bypassing the atomizing core 200. Therefore, the loss of the smoke bypassing the atomizing core 200 may be reduced, which can ensure that the sufficient amount of the smoke generated per unit time can be inhaled by the user, thus increasing the effective amount of the smoke per unit time generated by the electronic atomizing device 10. Further, since the distance between the atomizing surface 211*a* and the mouthpiece 121 is relatively small, making the path of the smoke to the mouthpiece 121 the shortest, which can reduce the loss of the smoke in the air suction channel 120, and hence improve the effective amount of the smoke per unit time generated by the electronic atomizing device 10. Therefore, for the same effective amount of the smoke generated by the electronic atomizing device 10, the power of the battery 320 may be reduced in favor of reducing the electric power consumption of the electronic atomizing device 10 and improving the battery life of the battery 320.

When the mouthpiece 121 is drawn by the user, the external air goes through the air inlet 314, the air guiding channel 313, and the air suction channel 120 successively, and then is inhaled by the user. The air guiding channel 313 is separated from the cavity 311*a*, the external air entering from the air inlet 314 can be prevented from entering the air suction channel 120 via the cavity 311*a*, thus avoiding the disturbance to the stability of the airflow from the cavity 311*a*, and preventing the air from entering the cavity 311*a* to generate a fluctuation amount of the smoke, such that the airflow finally entering the air suction channel 120 from the independent air guiding channel 313 is more stable, and hence improves the stability of the amount of the smoke in the air suction channel 120, and avoids an unfavorable user experience due to the fluctuation amount of the smoke.

Further, since the air suction channel 120 is isolated from the cavity 311*a* for receiving the battery 320, the condensate generated in the atomizing process cannot enter the cavity 311*a*, thereby avoiding corrosion of the condensate to the battery 320 received in the cavity 311*a* and preventing the short circuit.

Figure 10:
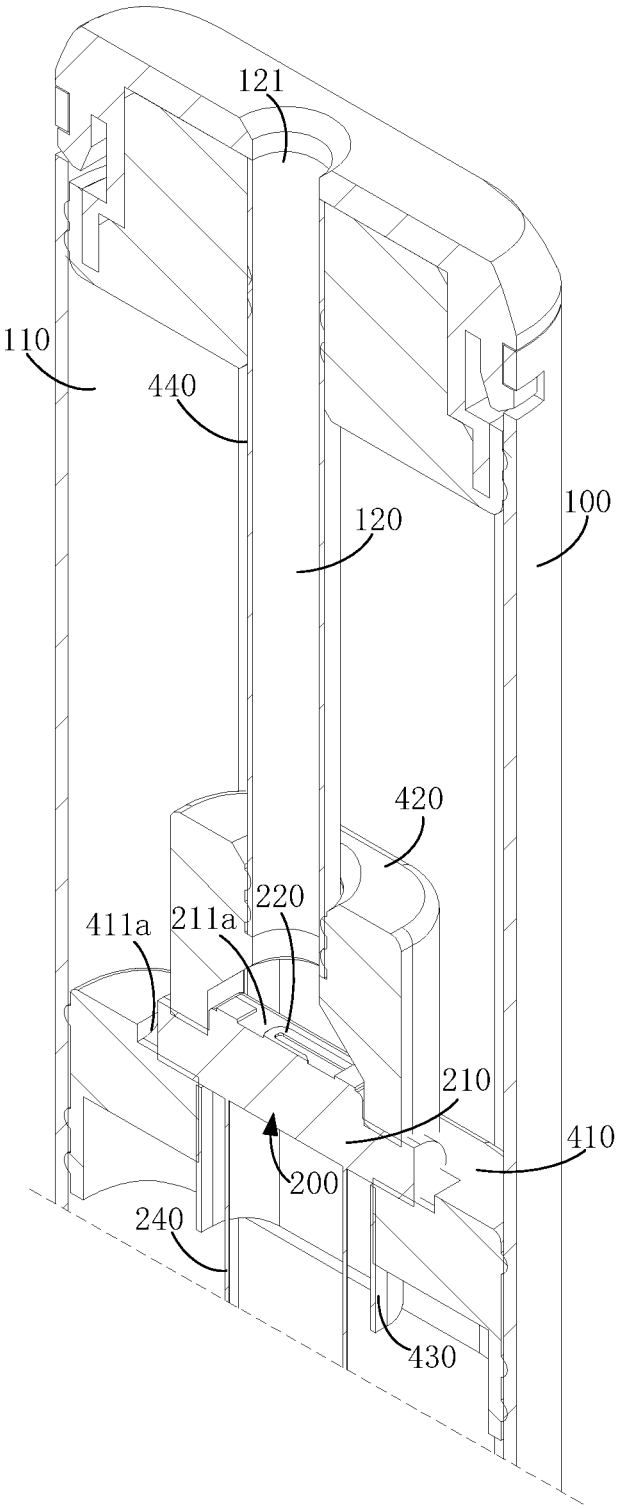
FIG. 10 is a cross-sectional view of an atomizer according to an embodiment.

Referring to FIG. 10, one embodiment of an atomizer includes the housing 100, a connecting assembly 400, and the atomizing core 200 according to the electronic atomizing device 10.

The technical features of each embodiment can be combined at an arbitrary. In order to describe in a concise way, not all the possible combinations of the technical features of the above embodiments are described. However, they should be considered within the scope of the present invention, as long as the combination of these technical features is in no contradiction.

Although the present invention has been described with reference to the embodiments thereof and the best modes for carrying out the present invention, it is apparent to those skilled in the art that a variety of modifications and changes may be made without departing from the scope of the present invention, which is intend to be defined by the appended claims.

What is claimed is:

1. An electronic atomizing device comprising:

a battery; and an atomizing core configured to be electrically connected to the battery, the electronic atomizing device defining an air suction channel, the electronic atomizing device including a mouthpiece at an end of the air suction channel, the atomizing core comprising:

a base configured to store liquid and having an atomizing surface located in the air suction channel;

wherein the atomizing surface is arranged to face away from the battery and towards the mouthpiece; and a heater arranged on the atomizing surface and configured to atomize the liquid, wherein the base comprises a main body and a protrusion arranged in a middle portion of the main body and located in the air suction channel, the protrusion protrudes from a surface of the main body towards the mouthpiece, and the atomizing surface is arranged on the protrusion.

2. The electronic atomizing device according to claim 1, further comprising a pin, wherein the pin has one end that is electrically connected to the heater, and another end of the pin is electrically connected to the battery.

3. The electronic atomizing device according to claim 2, wherein the pin includes a part that extends through the base.

4. The electronic atomizing device according to claim 2, further comprising an electrode attached to the atomizing surface and connected to an end of the heater, an end of the pin being electrically connected to the electrode.

5. The electronic atomizing device according to claim 1, wherein the heater includes a heating film attached to the atomizing surface.

6. The electronic atomizing device according to claim 1, wherein the main body has two opposite end surfaces that are located outside the air suction channel, liquid infiltrates the main body via the end surfaces.

7. The electronic atomizing device according to claim 6, wherein the main body defines a liquid guiding hole extending along an axial direction thereof and penetrating the two end surfaces.

8. The electronic atomizing device according to claim 7, wherein the base is made of porous ceramic.

9. The electronic atomizing device according to claim 1, comprising:

a housing; and a connecting assembly;

wherein the housing defines a liquid reservoir;

wherein the connecting assembly is at least partially received in the housing;

wherein the atomizing core is mounted on the connecting assembly; and wherein the air suction channel is defined in the connecting assembly and is isolated from the liquid reservoir, a part of the base absorbs the liquid from the liquid reservoir.

10. The electronic atomizing device according to claim 9, wherein the connecting assembly includes a first sealing element configured to seal the liquid reservoir, a surface of the first sealing element facing the liquid reservoir forms a groove, the base is partially located in the groove, a liquid guiding gap is formed between an end surface of the base and an end surface of the groove.

11. The electronic atomizing device according to claim 10, wherein the connecting assembly further includes a support, a second sealing element and an air conduit, the support extends through the first sealing element, the base is sandwiched in the support, the air conduit is inserted in the second sealing element, the second sealing element is sleeved on the support and is provided with a mounting notch corresponding to the base, the second sealing element, the support and the air conduit cooperatively forms the air suction channel.

12. The electronic atomizing device according to claim 9, wherein the atomizing core further includes two pins extending through the base and the pins are arranged vertically, one end of the pins are electrically connected to the heater, and the other end of the pins are electrically connected to the battery.

13. The electronic atomizing device according to claim 9, wherein the heater includes a heating film bending into an S-shape and attached to the atomizing surface.

14. The electronic atomizing device according to claim 9, wherein the base shaped as cylinder or elliptic includes a main body and a protrusion arranged in a middle portion of the main body and located in the air suction channel, the protrusion protrudes from a surface of the main body towards the mouthpiece, and the atomizing surface is arranged on the protrusion.

15. The electronic atomizing device according to claim 9, wherein the base is made of porous ceramic and has a porosity ranges from 30% to 70%.

16. The electronic atomizing device according to claim 1, further comprising a power supply assembly, the power supply assembly being connected to the connecting assembly and at least partially received in the housing.

17. The electronic atomizing device according to claim 16, wherein the power supply assembly includes a mounting frame, the mounting frame defines a cavity isolated from the air suction channel, the battery is received in the cavity, an air guiding channel isolated from the cavity is formed between the mounting frame and the housing, the air guiding channel is in fluid communication with the air suction channel, external air enters the air suction channel via the air guiding channel.

18. The electronic atomizing device according to claim 17, wherein the mounting frame includes opposite first and second surfaces, the cavity is formed on the first surface, a recess is formed on the second surface, the housing covers the recess to form the air guiding channel.

19. The electronic atomizing device according to claim 17, wherein the mounting frame defines an air inlet on an end surface thereof outside the housing, the air inlet is in fluid communication with the air guiding channel, the external air entering from the air inlet goes into the air suction channel via the air guiding channel.

* * * * *